US010381790B1

(12) United States Patent
Andrews et al.

(10) Patent No.: US 10,381,790 B1
(45) Date of Patent: Aug. 13, 2019

(54) POWER OVER ETHERNET CONNECTION WITH POWER CONTROL

(71) Applicant: Cooper Technologies Company, Hoston, TX (US)

(72) Inventors: James C. Andrews, Mableton, GA (US); Kenneth Dale Walma, Peachtree City, GA (US); Geoffrey Granville Hammett, Norcross, GA (US); Mark Verheyen, Whitefish Bay, WI (US)

(73) Assignee: Cooper Technologies Company, Houston, TX (US)

( * ) Notice: Subject to any disclaimer, the term of this patent is extended or adjusted under 35 U.S.C. 154(b) by 24 days.

(21) Appl. No.: 15/462,421

(22) Filed: Mar. 17, 2017

Related U.S. Application Data

(60) Provisional application No. 62/310,531, filed on Mar. 18, 2016.

(51) Int. Cl.

| | |
|---|---|
| ***H01R 13/70*** | (2006.01) |
| ***H01R 13/703*** | (2006.01) |
| ***H01R 24/64*** | (2011.01) |
| ***H01R 13/717*** | (2006.01) |
| *H01R 107/00* | (2006.01) |
| *H01R 24/46* | (2011.01) |
| *H01R 13/713* | (2006.01) |
| *H01R 24/62* | (2011.01) |

(52) U.S. Cl.
CPC ..... *H01R 13/7036* (2013.01); *H01R 13/7175* (2013.01); *H01R 24/64* (2013.01); *H01R 13/70* (2013.01); *H01R 13/703* (2013.01); *H01R 13/713* (2013.01); *H01R 24/46* (2013.01); *H01R 24/62* (2013.01); *H01R 2107/00* (2013.01)

(58) Field of Classification Search
CPC .... H01R 13/70; H01R 13/703; H01R 13/713; H01R 24/46; H01R 24/62; H01R 24/64
See application file for complete search history.

(56) References Cited

U.S. PATENT DOCUMENTS

| | | | | |
|---|---|---|---|---|
| 6,056,568 | A * | 5/2000 | Arnett | H01R 13/6466 200/51.06 |
| 7,144,261 | B2 * | 12/2006 | Merlet | H01R 13/71 439/136 |
| 7,384,300 | B1 * | 6/2008 | Salgado | H01R 13/7035 439/489 |
| 7,431,601 | B2 * | 10/2008 | Nugent, Jr. | H01R 13/7132 200/51.1 |

* cited by examiner

*Primary Examiner* — Abdullah A Riyami
*Assistant Examiner* — Justin M Kratt
(74) *Attorney, Agent, or Firm* — King & Spalding LLP

(57) ABSTRACT

A controlled-power RJ45 socket includes a housing having a cavity to receive an RJ45 plug. The socket further includes electrical contacts positioned in the cavity and that come in contact with electrical contacts of the RJ45 plug when the RJ45 plug is plugged into the RJ45 socket. A switch is positioned to disconnect the power to the electrical contacts of the RJ45 socket before the electrical contacts of the RJ45 plug are physically detached from the electrical contacts of the RJ45 socket during a de-mating of the RJ45 plug from the RJ45 socket.

15 Claims, 14 Drawing Sheets

POWER OVER ETHERNET CONNECTION WITH POWER CONTROL

CROSS REFERENCE TO RELATED APPLICATIONS

The present application claims priority under 35 U.S.C. Section 119(e) to U.S. Provisional Patent Application No. 62/310,531, filed Mar. 18, 2016, and titled "Power Over Ethernet Connector With Controlled Power," the entire content of which is incorporated herein by reference.

TECHNICAL FIELD

The present disclosure relates generally to power over Ethernet and more particularly, to controlling availability of power through Ethernet connectors.

BACKGROUND

Power over Ethernet (PoE) technology enables powering and controlling of devices using Ethernet cables (e.g., CAT 5e cable) that are terminated with RJ45 connectors. As higher power devices become supported by PoE, the risk of damage to the contacts of RJ45 connectors has increased due to arcing during live de-mating and mating of RJ45 connectors. Because a power source is unaware of impending mating and de-mating of RJ45 connectors, the power source typically continues to provide power during de-mating of the connectors. Also, because a load device is unaware of impending mating and de-mating of RJ45 connectors, the load device typically continues to receive power during de-mating of the connectors. Damage to the contacts of an RJ45 connector due to electrical arcing can increase the electrical resistance of the contacts, which can reduce electrical efficiency and potentially lead to disruption of communications. Thus, a solution that enables controlling the availability of power at RJ45 connectors during mating and/or de-mating may be desirable.

SUMMARY

The present disclosure relates generally to power over Ethernet and more particularly, to controlling availability of power through Ethernet connectors. In an example embodiment, a controlled-power RJ45 socket includes a housing having a cavity to receive an RJ45 plug. The socket further includes electrical contacts positioned in the cavity and that come in contact with electrical contacts of the RJ45 plug when the RJ45 plug is plugged into the RJ45 socket. The socket also includes a switch positioned at least partially in the cavity to disconnect power to the electrical contacts of the RJ45 socket based on positions of the RJ45 plug in the cavity. The switch is positioned to disconnect the power to the electrical contacts of the RJ45 socket before the electrical contacts of the RJ45 plug are physically detached from the electrical contacts of the RJ45 socket during a de-mating of the RJ45 plug from the RJ45 socket.

In another example embodiment, a controlled-power RJ45 socket includes a housing having a cavity to receive an RJ45 plug. The socket further includes electrical contacts positioned to come in contact with electrical contacts of the RJ45 plug when the RJ45 plug is plugged into the RJ45 socket. The socket also includes a switch positioned at least partially in the cavity to indicate to a controller whether the switch is depressed or undepressed. The switch is depressed by the RJ45 plug when the RJ45 plug is mated with the RJ45 socket, and the controller controls whether power is provided to the electrical contacts of the RJ45 socket based on whether the switch is depressed or undepressed. The controller disconnects the power before the electrical contacts of the RJ45 plug are physically detached from the electrical contacts of the RJ45 socket during de-mating of the RJ45 plug from the RJ45 socket.

In another example embodiment, a device that receives power over an Ethernet cable includes a load component and an RJ45 socket having electrical contacts that come in contact with electrical contacts of the RJ45 plug when the RJ45 plug is plugged into the RJ45 socket. The device further includes a switch positioned to restrict access to a locking tab of the RJ45 plug when the RJ45 plug is mated with the RJ45 socket. The switch restricts access to the locking tab of the RJ45 plug when the switch is in a power-on position, and access to the locking tab of the RJ45 plug is unrestricted when the switch is in a power-off position. Power provided to the load component through the RJ45 socket is disconnected between the RJ45 socket and the load component in response to the switch being in the power-off position.

These and other aspects, objects, features, and embodiments will be apparent from the following description and the appended claims.

BRIEF DESCRIPTION OF THE DRAWINGS

The foregoing and other features and aspects of the disclosure are best understood with reference to the following description of certain example embodiments, when read in conjunction with the accompanying drawings, wherein.

Figure 1:
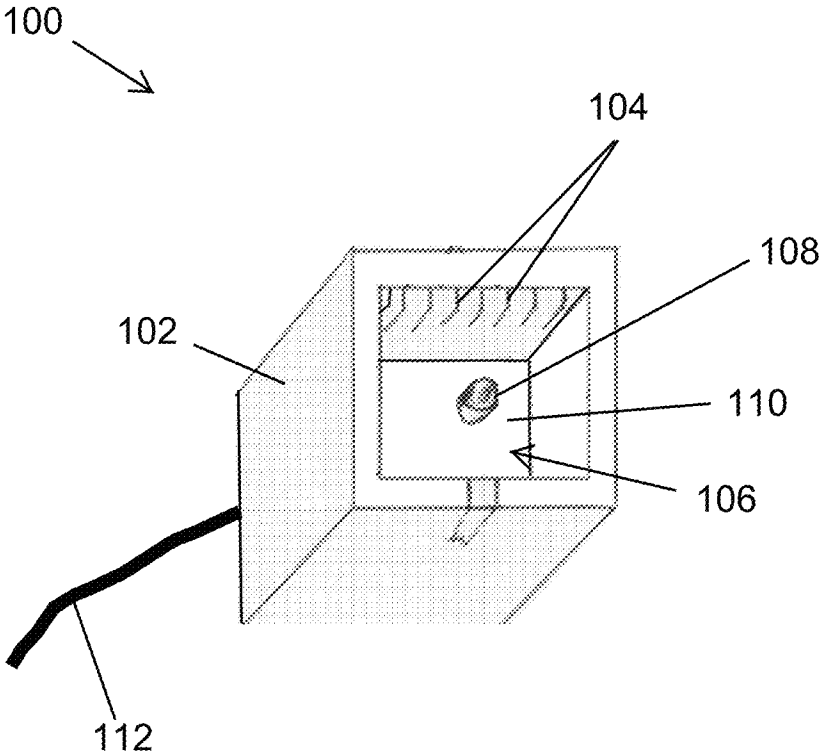
FIG. 1 illustrates a controlled-power RJ45 socket according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments.

Additionally, certain dimensions or placements may be exaggerated to help visually convey such principles. In the figures, the same reference numerals designate like or corresponding, but not necessarily identical, elements.

DETAILED DESCRIPTION OF EXAMPLE EMBODIMENTS

In the following paragraphs, particular embodiments will be described in further detail by way of example with reference to the figures. In the description, well known components, methods, and/or processing techniques are omitted or briefly described. Furthermore, reference to various feature(s) of the embodiments is not to suggest that all embodiments must include the referenced feature(s).

The term RJ45 socket as used herein generally refers to a socket used in Power over Ethernet (PoE) connections and systems such as a standard RJ45 socket and other sockets that may be used in PoE connections and systems, where an Ethernet cable is used for providing power as well as data. The term RJ45 plug as used herein generally refers to a plug used in PoE connections and systems such as a standard RJ45 plug and other plugs that may be used in PoE connections and systems, where an Ethernet cable is used for providing power as well as data. The term a RJ45 connector as used herein generally refers to a connector used in PoE connections and systems such as a standard RJ45 connector (i.e., a standard RJ45 socket or a standard RJ45 plug) and other connectors that may be used in PoE connections and systems, where an Ethernet cable is used for providing power as well as data.

Turning now to the drawings, FIG. 1 illustrates a controlled-power RJ45 socket 100 according to an example embodiment. Referring to FIG. 1, the controlled-power RJ45 socket 100 includes a housing 102, electrical contacts 104, and a switch 108. The switch 108 is positioned at least partially in a cavity 106 of the housing 102. For example, the switch 108 may be positioned at a back wall 110. The housing 102 may include the back wall 110 such that a portion of the switch 108 extends into the cavity 106 through an opening in the back wall 110. Alternatively, a portion of the switch 108 may serve as the back wall 110. For example, the switch 108 may be positioned at a back end of the housing 102 such that a side wall of the switch 108 is the back wall 110 enclosing a back opening of the housing 102.

In some example embodiments, the cavity 106 is sized to receive a standard RJ45 plug. For example, the cavity 106 may have standard dimensions of a typical RJ45 socket. To illustrate, the electrical contacts 104 may be spaced such that when the RJ45 plug (shown for example in FIG. 2) is plugged into the controlled-power RJ45 socket 100, the electrical contacts of the RJ45 plug come in physical contact with the electrical contacts 104 of the controlled-power RJ45 socket 100. Electrical continuity between the electrical contacts 104 and an electrical cable 112 connected to the switch 108 of the RJ45 socket 100 depends on the state of the switch 108, i.e., on whether the switch 108 is open or closed.

For example, in some example embodiments, the electrical cable 112 (e.g., CAT 5 cable) may be terminated at the controlled-power RJ45 socket 100. To illustrate, the switch 108 may be connected to power source equipment. The electrical cable 112 may be connected to the switch 108, and the switch 108 may be connected to the electrical contacts 104 such that the switch 108 provides a controlled electrical connection between the electrical contacts 104 and the cable 112 based on whether the switch 108 is open or closed.

The electrical contacts 104 may be connected to terminals of the switch 108 directly or via intermediate wiring/traces. For example, the electrical contacts 104 may be soldered to terminals of the switch 108 or attached by other means as may be contemplated by those of ordinary skill in the art with the benefit of this disclosure. The cable 112 may be soldered to opposite terminals of the switch 108 or attached by other means as may be contemplated by those of ordinary skill in the art with the benefit of this disclosure.

In some example embodiments, the switch 108 is a normally open switch such that power from power source equipment that is connected to the cable 112 is unavailable at the electrical contacts 104 until the switch 108 is closed. For example, the switch 108, which may be a normally open momentary switch, may be closed by depressing/pushing the switch 108. To illustrate, closing the switch 108 can provide electrical continuity between the cable 112 connected to the switch 108 and the electrical contacts 104 of the controlled-power RJ45 socket 100.

In some example embodiments, the switch 108 may be closed by an RJ45 plug that is mated with the controlled-power RJ45 socket 100. To illustrate, the switch 108 may be positioned in the cavity 106 such that when the RJ45 plug is being inserted into the cavity 106 during the mating of the RJ45 plug with the controlled-power RJ45 socket 100, the electrical contacts 104 of the controlled-power RJ45 socket 100 come in physical contact with the electrical contacts of the RJ45 plug prior to the RJ45 plug coming in contact with the switch 108. Because the switch is open at this stage, no electrical connection exists between the cable 112 connected to the power source and the electrical contacts 104. To close the switch 108, the RJ45 plug may be pushed further into the cavity 106, which closes the switch 108 by pushing/depressing the switch 108, while the electrical contacts 104 of the controlled-power RJ45 socket 100 and the electrical contacts of the RJ45 plug remain in physical contact with each other. Thus, the switch 108 can remain open even after the electrical contacts 104 of the controlled-power RJ45 socket 100 have initially come in contact with the electrical contacts of the RJ45 plug until the RJ45 plug is pushed further into the RJ45 socket 100 closing the switch 108.

The switch 108 is positioned in the cavity 106 of the RJ45 socket 100 such that the switch 108 opens before the electrical contacts 104 of the controlled-power RJ45 socket 100 are physically disconnected from the electrical contacts of the RJ45 plug when an RJ45 plug that is mated with the RJ45 socket 100 is being de-mated from the controlled-power RJ45 socket 100. In some example embodiments, the switch 108 may be a multiple pole switch that matches the number of electrical contacts 104. For example, the switch 108 may be an 8-pole switch. Alternatively, the switch 108 may have less or more poles than the number of electrical contacts 104. For example, two or more of the electrical contacts 104 may be connected to the same terminal of the switch 108. Further, in some example embodiments, fewer than all the electrical contacts 104 of the RJ45 socket 100 may be connected and controlled by the switch 108.

During the de-mating of an RJ45 plug from the RJ45 socket 100, the controlled-power RJ45 socket 100 reduces the risk of arching by disconnecting electrical paths between the cable 112 and the electrical contacts 104 of the controlled-power RJ45 socket 100 (i.e., discontinuing power to the electrical contacts 104) prior to the physical disconnection of the electrical contacts of the RJ45 plug from the electrical contacts 104 of the RJ45 socket 100. During the mating of an RJ45 plug with the RJ45 socket 100, the controlled-power RJ45 socket 100 reduces the risk of arching by delaying the availability of power at the electrical contacts 104 of the controlled-power RJ45 socket 100 until after the electrical contacts of the RJ45 plug are in contact with the electrical contacts 104 of the controlled-power RJ45 socket 100.

Although the switch 108 is positioned at the back of the housing 102 in FIG. 1, in some alternative embodiments, the switch 108 may be at a different location within or outside the cavity 106. For example, the switch 108 may be positioned such that when the RJ45 plug is being mated with controlled-power RJ45 socket 100, the RJ45 plug comes in contact with the switch 108, without closing the switch 108, prior to or at the same time as the electrical contacts 104 coming in physical contact with the electrical contacts of the RJ45 plug. Further movement of the RJ45 plug into the cavity 106 can then close the switch 108 by pushing/depressing the switch 108 after the respective electrical contacts of the RJ45 plug and the controlled-power RJ45 socket 100 are in physical contact with each other.

In some alternative embodiments, the switch 108 may be located at a different location at the back of the housing 102 without departing from the scope of this disclosure. The switch 108 may also be positioned at a location other than the back of the housing 102 without departing from the scope of this disclosure. In some alternative embodiments, the housing 102 may have a shape other than shown in FIG. 1 without departing from the scope of this disclosure.

Figure 2A:
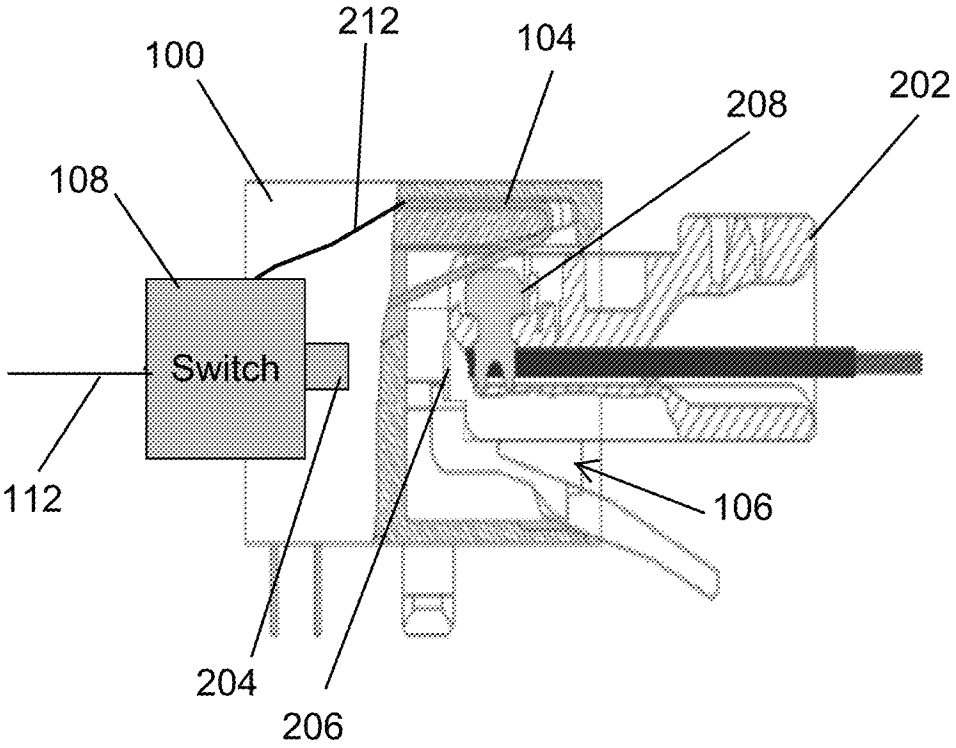
FIG. 2A illustrates the controlled-power RJ45 socket of FIG. 1 partially mated/de-mated with an RJ45 plug according to an example embodiment.

FIG. 2A illustrates the controlled-power RJ45 socket 100 of FIG. 1 partially mated/de-mated with an RJ45 plug 202 according to an example embodiment. Referring to FIGS. 1 and 2A, the controlled-power RJ45 socket 100 includes the electrical contacts 104 and the switch 108. The switch 108 includes a button 204 that is shown in FIG. 2A as undepressed, which may be a position that corresponds to the switch 108 being in an open state. The switch 108 is connected to the electrical contacts 104 by electrical wires 212. Alternatively, the wires 212 may be part of the electrical contacts 104.

In some example embodiments, the cable 112 is connected to the switch 108. The cable 112 may include a number of twisted pairs. For example, the cable 112 may include four twisted pairs that can be electrically connected to the electrical contacts 104 of the RJ45 socket 100 through the switch 108. The wiring of the twisted pairs to the electrical contacts 104 through the switch 108 may be based on a wiring standard such as TIA/EIA-568. In some example embodiments, the cable 112 may be CAT 5 or another similar Ethernet cable. For example, the cable 112 may carry data and/or power from power source equipment that can send and receive data and that can provide power to a device that is electrically connected to the controlled-power RJ45 socket 100 through the RJ45 plug 202.

As shown in FIG. 2A, the button 204 is undepressed (i.e., the switch 108 is open) although the RJ45 plug 202 is partially positioned in the cavity 106 of the RJ45 socket 100. Considering FIG. 2A as showing a partially mated position of the RJ45 plug 202 during the mating of the RJ45 plug 202 with the RJ45 socket 100, electrical contacts 208 of the RJ45 plug are already in contact with respective electrical contacts 104 of the controlled-power RJ45 socket 100 before the RJ45 plug 202 comes in contact with the button 204 of the switch 108. Because the switch 108 is in the open position, electrical connection between the cable 112 and the electrical contacts 104, 208 is not established. When the button 204 of the switch 108 is adequately depressed/pushed by the RJ45 plug 202 as a result of the RJ45 plug 202 moving further toward the switch 108, the switch 108 becomes closed. For example, a user may push the RJ45 plug 202 further into the RJ45 socket 100 to achieve full mating of the plug 202 with the RJ45 socket 100. To illustrate, a front surface 206 of the RJ45 plug 202 may come in contact with the button 204 and press/depress the button 204, closing the switch 108. The closing of the switch 108 establishes electrical connection between the cable 112 and the electrical contacts 104, 208.

Considering the position of the RJ45 plug 202 shown in FIG. 2A as a partially de-mated position during de-mating of the RJ45 plug 202 from the controlled-power RJ45 socket 100, FIG. 2 illustrates the electrical contact 208 of the RJ45 plug 202 is in contact with the electrical contact 104 of the controlled-power RJ45 socket 100 even though the switch 108 is already open as a result of the RJ45 plug having moved away from the switch 108 and no longer pressing/depressing the button 202. The electrical connection between the cable 112 and the electrical contacts 104, 208 is disconnected before the electrical contacts 208 of the RJ45 plug 202 are disconnected from the corresponding electrical contacts 104 of the RJ45 socket 100. Thus, when the electrical contact 208 is physically disconnected from the electrical contact 104 to complete the de-mating, electrical power to the electrical contact 104 through the switch 108 has already been discontinued, thus reducing or eliminating risk of electrical arcing between the contacts 104 and the contacts 208.

Although one of the contacts 104 and one of the electrical contacts 208 are shown in FIG. 2A for illustrative purposes, the relevant description provided herein is applicable to the other electrical contacts 104 of the controlled-power RJ45 socket 100 and the respective electrical contacts 208 of the RJ45 plug 202.

Figure 2B:
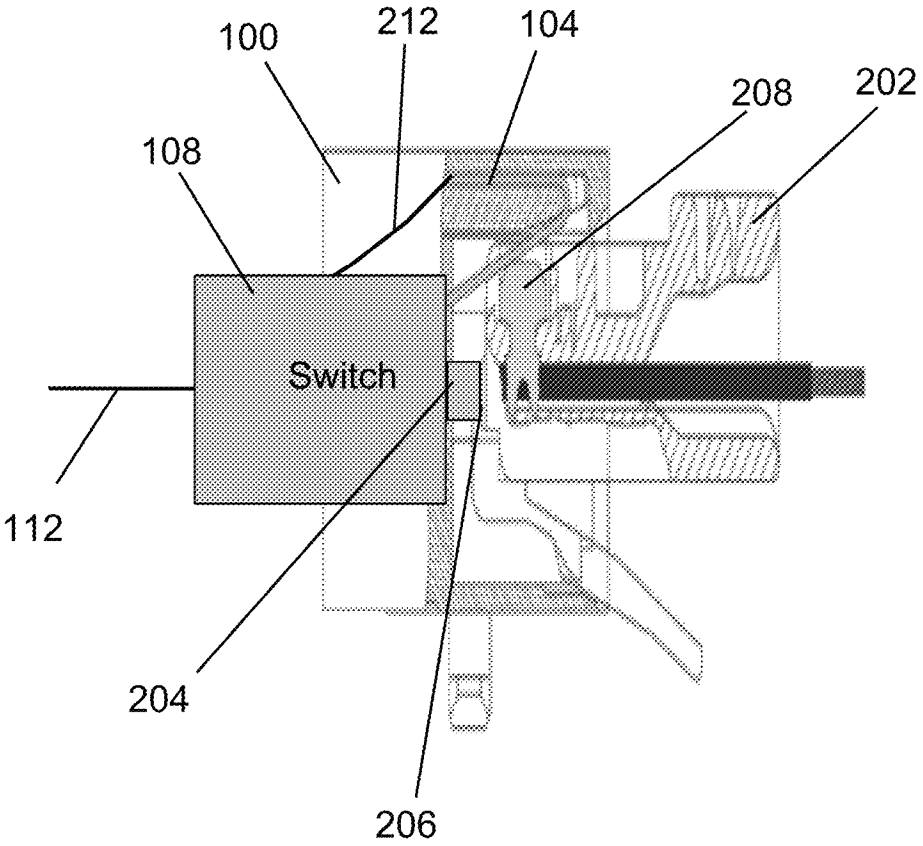
FIG. 2B illustrates the controlled-power RJ45 socket of FIG. 1 fully mated with an RJ45 plug according to an example embodiment.

FIG. 2B illustrates the controlled-power RJ45 socket 100 of FIG. 1 mated fully with an RJ45 plug 202 according to an example embodiment. Referring to FIGS. 1, 2A and 2B, the RJ45 plug 202 may be positioned in the cavity 106 of the RJ45 socket 100 such that the button 204 of the switch 108 is depressed by the RJ45 plug 202 as shown in FIG. 2B. To illustrate, in FIG. 2B, the RJ45 plug 202 has depressed the button 204 such that the switch 108 is closed.

Considering FIG. 2B as showing the position of the RJ45 plug 202 at the end of the mating of the RJ45 plug 202 with the RJ45 socket 100, the electrical contacts 208 remain in contact with the electrical contacts 104 as the RJ45 plug 202 moves further into the cavity 106 of the RJ45 socket 100 from the position shown in FIG. 2A. Because the electrical contact 208 came in physical contact prior to the RJ45 plug 202 depressing the button 204 and thus closing the switch 108, the risk of arcing between the electrical contact 208 and the electrical contact 104 is reduced during mating of the controlled-power RJ45 socket 100 and the RJ45 plug 202.

Considering FIG. 2B as showing the position of the RJ45 plug 202 immediately before the de-mating of the RJ45 plug 202 from the RJ45 socket 100, the electrical contacts 208 remain in contact with the electrical contacts 104 as the RJ45 plug 202 moves from the position shown in FIG. 2B to the position shown in FIG. 2A. Because the electrical contacts 208 remain in physical contact with the electrical contacts 104 after the switch 108 is open, the risk of arcing between the electrical contacts 208 and the electrical contact 104 is reduced during the de-mating of the controlled-power RJ45 socket 100 and the RJ45 plug 202.

Although one of the contacts 204 and one of the electrical contacts 104 are shown in FIG. 2B for illustrative purposes, the relevant description provided herein is applicable to the other respective electrical contacts 104 of the controlled-power RJ45 socket 100 and the electrical contacts of the RJ45 plug 202.

Figure 3:
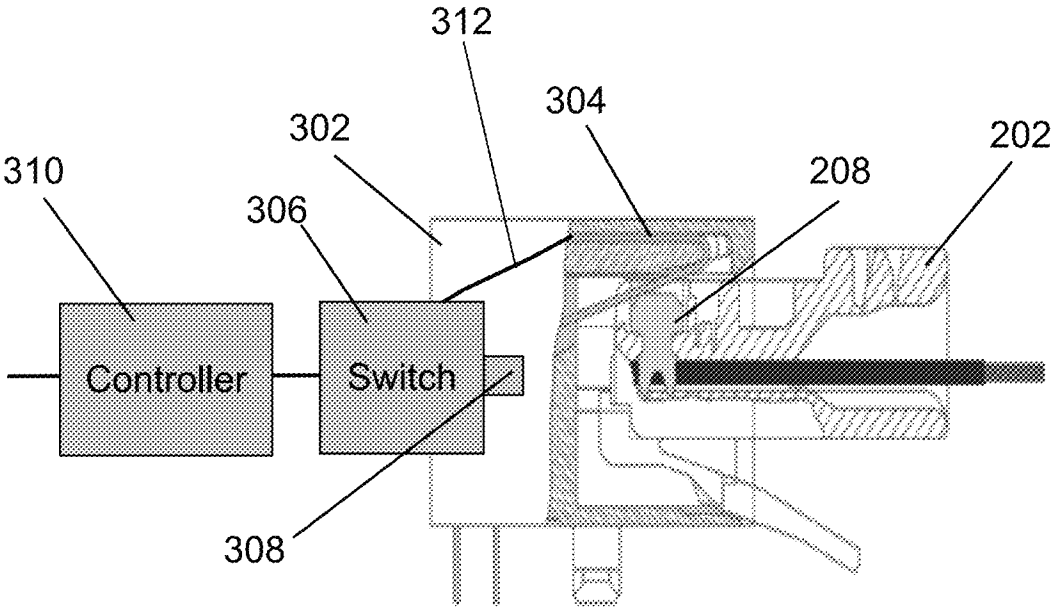
FIG. 3 illustrates a controlled-power RJ45 socket according to another example embodiment.

FIG. 3 illustrates a controlled-power RJ45 socket 302 according to another example embodiment. The controlled-power RJ45 socket 302 is substantially the same as the controlled-power RJ45 socket 100 of FIG. 1. In some example embodiments, the controlled-power RJ45 socket 302 includes a switch 306 that is connected to a controller 310. For example, the controller 310 may be part of or inside power source equipment. The RJ45 socket 302 also includes the electrical contacts 304 that are electrically coupled to the switch 306 by electrical wires 312. For example, the electrical contacts 304 may correspond to the electrical contacts 104 of the RJ45 socket 100, and the electrical wires 312 may correspond to the electrical wires 212 of the RJ45 socket 100.

In some example embodiments, the switch 306 may provide a signal to the controller to indicate whether a button 308 of the switch 306 has been depressed. That is, the switch 306 may provide a signal to the controller to indicate whether the switch 306 is open or closed. For example, the button 306 may be depressed or undepressed depending on the position of the RJ45 plug 202 relative to the button 308 as described above with respect to FIGS. 1, 2A and 2B. During the mating of the RJ45 plug 202 with the controlled-power RJ45 socket 302, the electrical contacts 208 and the electrical contacts 304 come in physical contact with each other prior to the RJ45 plug 202 depressing the button 308 as described above with respect to the RJ45 plug 202 and the controlled-power RJ45 socket 100 of FIGS. 1, 2A, and 2B. During the de-mating of the RJ45 plug 202 from the controlled-power RJ45 socket 302, the electrical contacts 208 and the electrical contacts 304 remain in physical contact with each other after the RJ45 plug 202 is no longer depressing the button 308 as described above with respect to the electrical contacts 104, 208 and the de-mating of the RJ45 plug 202 from the controlled-power RJ45 socket 100.

In some example embodiments, the controller 310 may determine whether power is to be provided to electrical contacts 304 of the controlled-power RJ45 socket 302 based on the signal from the switch 108. For example, the signal provided may have one value (e.g., a particular voltage level) when the button 308 is depressed and may have another value (e.g., another voltage level) when the button 308 is undepressed. To illustrate, the controller 310 may determine that power should be provided to the controlled-power RJ45 socket 100 from the power source equipment when the signal from the switch 306 indicates that the switch 306 is closed. The controller 310 may also determine that power should not be provided to the controlled-power RJ45 socket 100 by the power source equipment when the signal from the switch 306 indicates that the switch 306 is open. The controller 310 may indicate to the power source whether power source should provide power to the electrical contacts 304 of the RJ45 socket 100 depending on whether the switch is open or closed as determined by the controller 310 depending on the signal from the switch 306. The power source may provide the power to the electrical contacts 304 through the switch 306 via the connection 312 or alternatively via an electrical cable, such as the electrical cable 614 of FIG. 6) that is connected to the electrical contacts 304 bypassing the switch 306. To illustrate, in some alternative embodiments, the connection 312 may be omitted and the power source, such as the power source equipment shown in FIGS. 5 and 6, may be coupled directly to the electrical contacts 304 of the RJ45 socket 302 bypassing the switch 306.

In some example embodiments, the signal provided to the controller 310 by the switch 308 may originate from the controller 310 and may be changed by the switch 308 based on whether the switch 306 is depressed. The controller 310 may include an analog-to-digital converter that converts the signal from the switch 108 into a digital signal that can be further processed. Alternatively, the switch 306 may provide a digital signal to the controller 310.

By controlling whether power is provided to the switch 306 by a power source based on the state of the switch 306, the risk of arcing between the electrical contacts 208 and the electrical contact 304 is reduced during mating and de-mating between the RJ45 plug 202 and the RJ45 socket 302.

In some example embodiments, the controller 310 may be integrated with the switch 306. In some example embodiments, the controller 310 may control whether power is provided to the switch 306 by the power source by controlling another device that is coupled to the switch 306.

Figure 4:
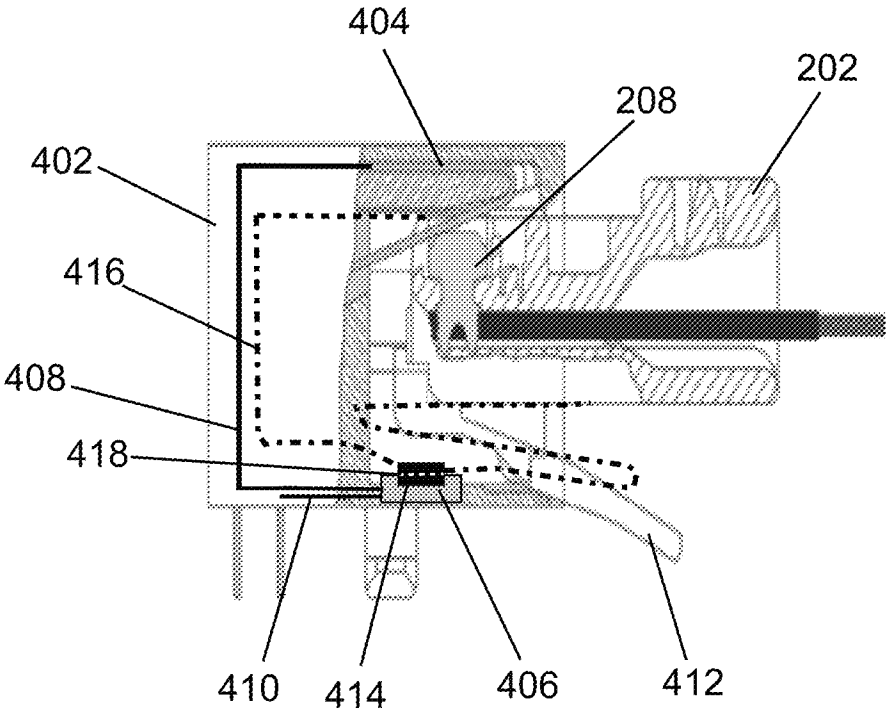
FIG. 4 illustrates a controlled-power RJ45 socket according to another example embodiment.

FIG. 4 illustrates a controlled-power RJ45 socket 402 according to an example embodiment. The controlled-power RJ45 socket 402 can operate generally as described with respect to the controlled-power RJ45 socket 100 or the controlled-power RJ45 socket 302. In some example embodiments, the RJ45 socket 402 includes electrical contacts 404 and a switch 406 that is connected to the electrical contacts 404 by electrical wires 408. The switch 406 may also be connected to power source equipment by an electrical cable 410. For example, the switch 406 may operate similarly to the switches 108, 306 described above, and the electrical cable 410 may correspond to the cable 112 shown in FIG. 1.

As illustrated in FIG. 4, the switch 406 may be positioned on a side wall of the controlled-power RJ45 socket 402 in contrast to the locations of the switches 108 and 306 described above with respect to the controlled-power RJ45 socket 100 and the controlled-power RJ45 socket 302, respectively. During the mating of the RJ45 plug 202 with the RJ45 socket 402, the button 414 of the switch 406 is depressed, toggled, or pushed by a locking tab 412 of the RJ45 plug 202, as illustrated by the dotted lines 416 and 418, after the electrical contacts 404 of the controlled-power RJ45 socket 402 have come in physical contact with the electrical contacts 208 of the RJ45 plug 202. Because the switch 406 becomes closed after the electrical contacts 404 are physically in contact with the electrical contacts 208, the risk of arcing between the electrical contacts 208 and the electrical contact 404 is reduced during mating of the RJ45 plug 202 from the RJ45 socket 402. The switch 406 may be a push button switch, a toggle switch, a slide switch, or another type of switch. The term depress, press, toggle, or push as used herein may be interpreted to refer to an action applicable to the particular type of switch.

During the de-mating of the RJ45 plug 202 from the RJ45 socket 402, the button 414 of the switch 406 is released (i.e., undepressed) by the locking tab 412 of the RJ45 plug 202 before the electrical contacts 404 of the RJ45 socket 402 become physically disconnected from the electrical contacts 208 of the RJ45 plug 202. Because the switch 406 becomes open before the electrical contacts 404 are physically disconnected from the electrical contacts 208, the risk of arcing between the electrical contacts 208 and the electrical contact 404 is reduced during de-mating of the RJ45 plug 202 from the RJ45 socket 402.

Although the switch 406 is shown at a particular position on the bottom of the housing of the RJ45 socket 402, in some alternative embodiments, the switch 406 may be located at a different location on the bottom wall without departing from the scope of this disclosure. In some alternative embodiments, the controlled-power RJ45 socket 402 may be used with the controller 310 of FIG. 3 without departing from the scope of this disclosure.

Figure 5:
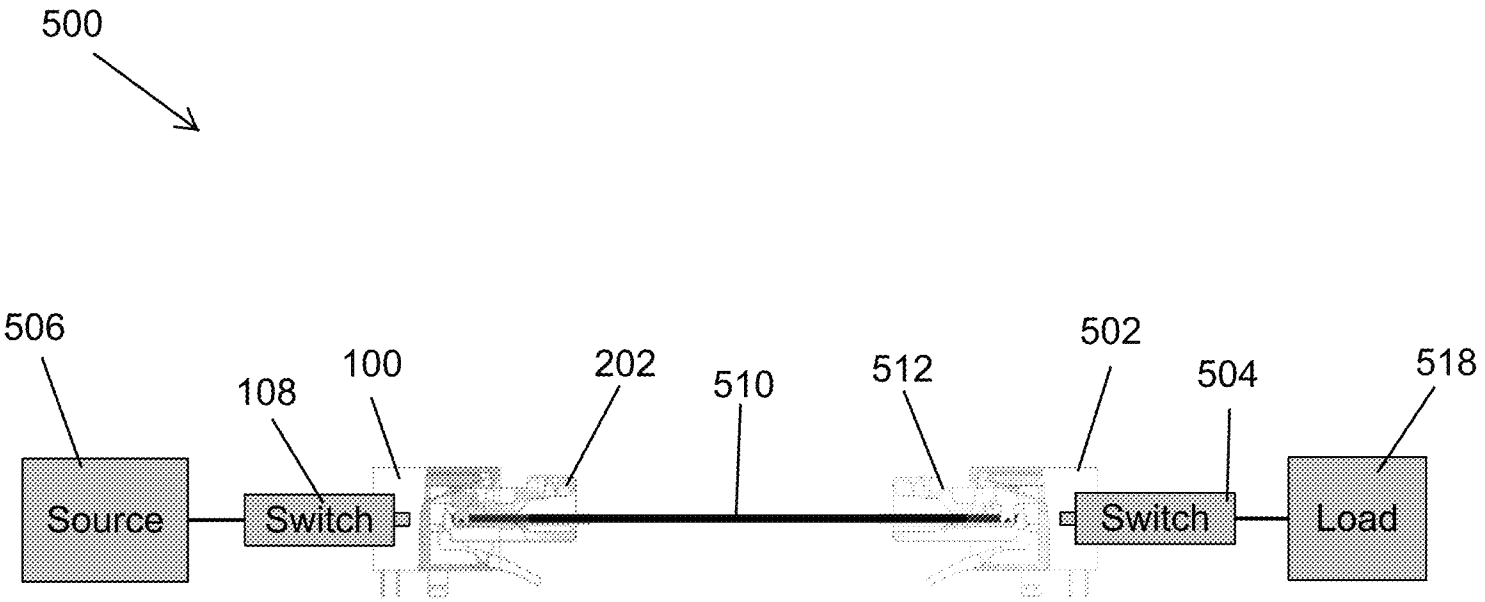
FIG. 5 illustrates a system including the controlled-power RJ45 socket of FIG. 1 according to an example embodiment.

FIG. 5 illustrates a system 500 that includes the controlled-power RJ45 socket 100 of FIG. 1 according to an example embodiment. As illustrated in FIG. 5, the system 500 includes the controlled-power RJ45 socket 100 coupled to power source equipment (PSE) 506. The PSE 506 may be designed to provide power to a load 518. The load 518 is connected to the PSE 506 through a cable 510 (e.g., CAT 5e cable) that connects the controlled-power RJ45 socket 100 and a controlled-power RJ45 socket 502. For example, the load 518 may be a lighting fixture. The cable 510 may be terminated at the RJ45 plug 202 at one end and at an RJ45 plug 512 at the other end, where the RJ45 plug 512 can be plugged into the RJ45 socket 502. To illustrate, the RJ45 socket 502 may be another instance of the controlled-power RJ45 socket 100. For example, the RJ45 socket 502 may include a switch 504 that operates in the same manner as the switch 108 of the RJ45 socket 100.

To illustrate, the switch 504 may connect power to the load 518 when the switch 504 is depressed by the RJ45 plug 512, and the switch 504 may disconnect power to the load 518 when the switch 504 is undepressed (i.e., not depressed). For example, the power path between the electrical contacts of the RJ45 socket 502 and the load 518 may include the switch 504 and the power path may be connected or disconnected depending on whether the switch 504 is open or closed, which depends on whether the switch 504 is depressed or undepressed (i.e., whether the button of the switch 504 is depressed or undepressed).

The RJ45 socket 502 may be integrated into the load 518 or may be external to the load 518. For example, a lighting fixture may include the load 518 and the RJ45 socket 502 that includes the switch 504. Alternatively, the RJ45 socket 502 including the switch 504 may be external to a light fixture that includes the load 518 and may be connected to the load 518 by an electrical cable.

In some example embodiments, the PSE 506 may also send and receive data to/from the load 518 through the cable 510. As described with respect FIGS. 1, 2A, and 2B, during de-mating, because the switch 108 discontinues power provided by the PSE 506 to the electrical contacts 104 of the controlled-power RJ45 socket 100 before the electrical contacts 208 of the RJ45 plug 202 are physically disconnected from the electrical contacts 104 of the controlled-power RJ45 socket 100, the risk of arcing between the contacts 104, 208 is reduced or eliminated. During mating, because the switch 108 allows power from the PSE 506 to reach the electrical contacts of the controlled-power RJ45 socket 100 only after the electrical contacts 208 of the RJ45 plug 202 are physically connected to the electrical contacts 104 of the controlled-power RJ45 socket 100, the risk of arcing between the contacts 104, 202 is reduced or eliminated.

In some example embodiments, the mating and de-mating of the controlled-power RJ45 socket 502 and the RJ45 plug 512 may be performed with reduced risk of arcing in a similar manner as described with respect to the controlled-power RJ45 socket 100 and the RJ45 plug 202. In some example embodiments, the RJ45 socket 402 may be used in the system 500 without departing from the scope of this disclosure. In some alternative embodiments, the controlled-power RJ45 socket 502 may be replaced by a standard RJ45 socket that does not include the power control switch 504 without departing from the scope of this disclosure. In some alternative embodiments, the controlled-power RJ45 socket 100 may be replaced by a standard RJ45 socket that does not include a power control switch 108 without departing from the scope of this disclosure.

Figure 6:
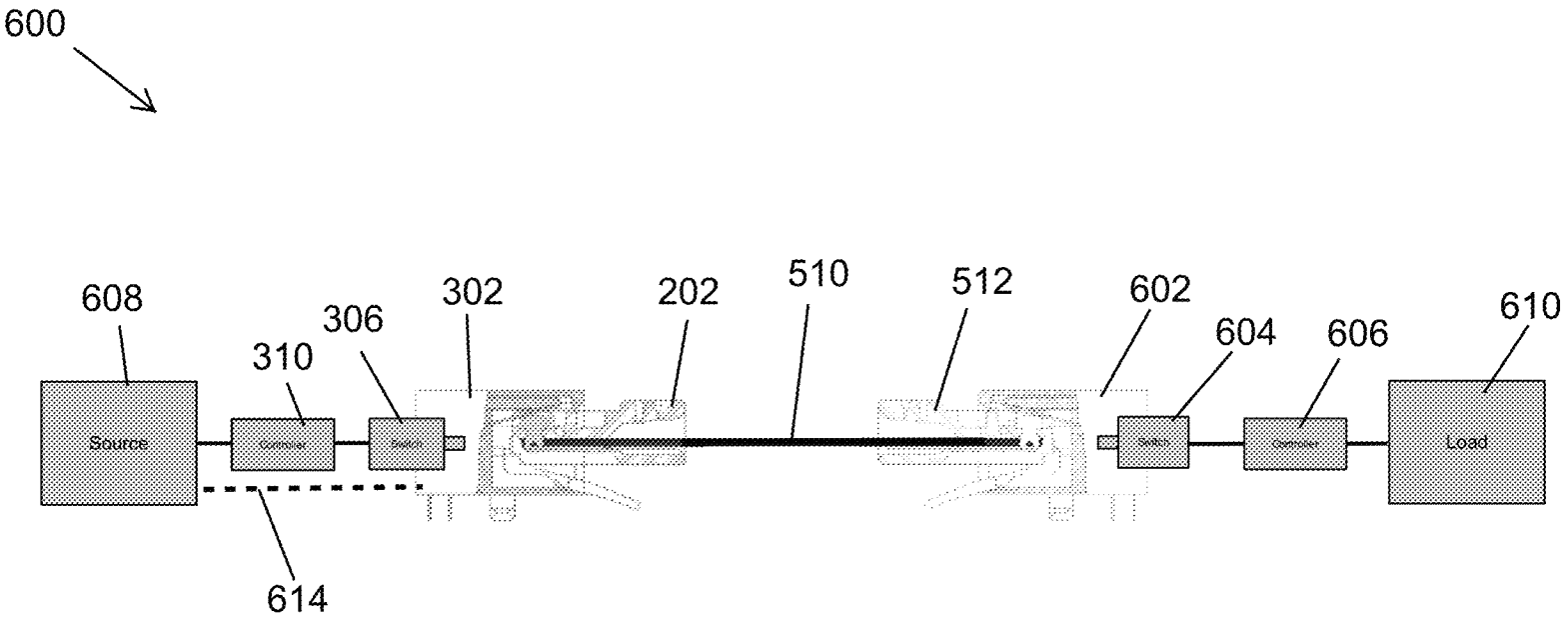
FIG. 6 illustrates a system including a controlled-power RJ45 socket of FIG. 3 according to an example embodiment.

FIG. 6 illustrates a system 600 including a controlled-power RJ45 socket 302 of FIG. 3 according to an example embodiment. The system 600 may include the controlled-power RJ45 socket 302, power source equipment (PSE) 608, and the controlled-power RJ45 socket 602. The PSE 608 may be designed to provide power to a load 610, such as a light fixture using the cable 510 that is terminated at the RJ45 plug 202 and the RJ45 plug 512 described above. For example, the PSE 608 may correspond to the PSE 506.

In some example embodiments, the controlled-power RJ45 socket 302 includes the switch 306 that is coupled to the controller 310 as described with respect to FIG. 3. The controller 310 is coupled to the PSE 608 and may indicate to the PSE 608 whether the PSE 608 should provide power to the electrical contacts 304 of the controlled-power RJ45 socket 302 based on the state of the switch 306 (i.e., depressed or undepressed, for example, by the RJ45 plug 202). The PSE 608 may provide power to the electrical contacts 304 through the switch 306 or directly via an electrical cable 614 bypassing the switch 306. The risk of arcing during mating and de-mating of the controlled-power RJ45 socket 302 and the RJ45 plug 202 may be reduced or eliminated as described above with respect to FIG. 3.

In some example embodiments, the RJ45 socket 602 may be another instance of the controlled-power RJ45 socket 100 or 300. For example, the RJ45 socket 602 may include a switch 604 that operates in the same manner as the switch 306 of the RJ45 socket 300. To illustrate, the controller 606 may indicate to the load 610 the state of the switch 604 based on information from the switch 604.

In some example embodiments, the mating and de-mating of the controlled-power RJ45 socket 602 and the RJ45 plug 512 may be performed with reduced risk of arcing in a similar manner as described above. In some example embodiments, the RJ45 socket 402 may be used in the system 600 without departing from the scope of this disclosure. In some alternative embodiments, the controlled-power RJ45 socket 602 may be replaced by a standard RJ45 socket without departing from the scope of this disclosure. In some alternative embodiments, the controlled-power RJ45 socket 100 may be replaced by a standard RJ45 socket without departing from the scope of this disclosure. In some alternative embodiments, the controller 310 may be integrated in the PSE 608 or in the switch 306 without departing from the scope of this disclosure.

Figure 7:
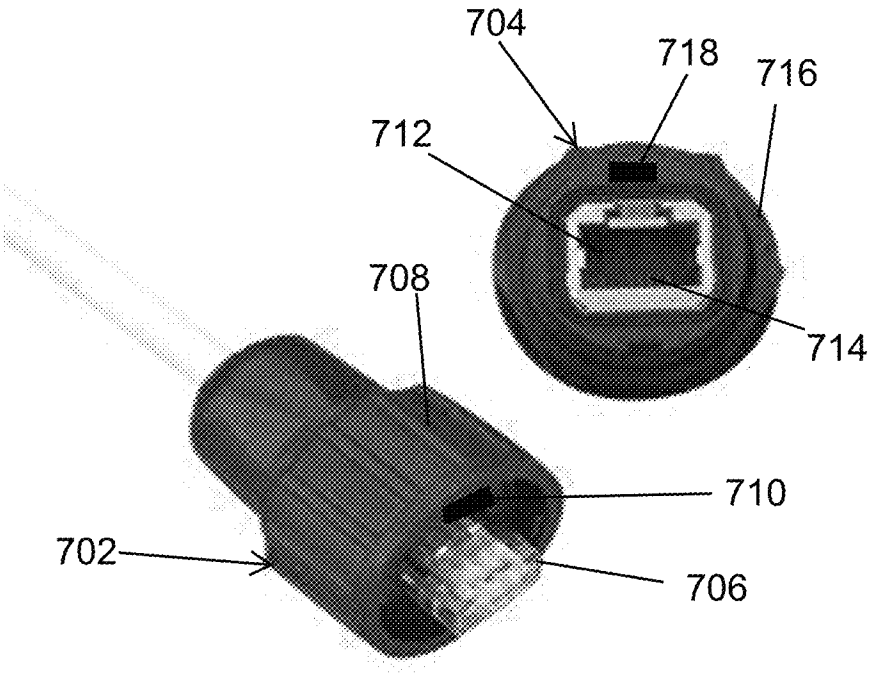
FIG. 7 illustrates a matching RJ45 male connector and controller-power RJ45 socket according to another example embodiment.

FIG. 7 illustrates matching RJ45 male connector 702 and controller-power RJ45 socket 704 according to another example embodiment. In some example embodiments, the RJ45 male connector 702 includes a plug 706 and a cover 708 that includes a protruding tab 710. The controller-power RJ45 socket 704 includes a cavity 712 for receiving the plug 706. Electrical contacts 714, which, for example, correspond to the electrical contacts 104 of FIG. 1, are in the cavity 712. The controller-power RJ45 socket 704 also includes a cover 716 that has a slot 718 that is designed to receive the tab 708.

Power to the electrical contacts 714 of the RJ45 socket 704 may be provided, for example by a PSE, only after the tab 710 and the slot 718 are interlocked with each other. To illustrate, the electrical contacts of the plug 706 may be positioned to come in contact with the respective electrical contacts 714 of the RJ45 socket 704 before the tab 710 and the slot 718 are interlocked to avoid arcing during the process of connecting the RJ45 male connector 702 with the RJ45 socket 704. During de-mating, the contacts of the plug 706 remain in contact with the electrical contacts 714 of the RJ45 socket 702 until after the tab 710 and the slot 718 are no longer interlocked with each other.

Although particular shapes of the covers 708, 716 are shown in FIG. 7, in alternative embodiments, the covers 708, 716 have other shapes without departing from the scope of this disclosure. Further, tab 710 and the slot 718 may be interchanged or may have other shapes and/or positions without departing from the scope of this disclosure.

Figure 8:
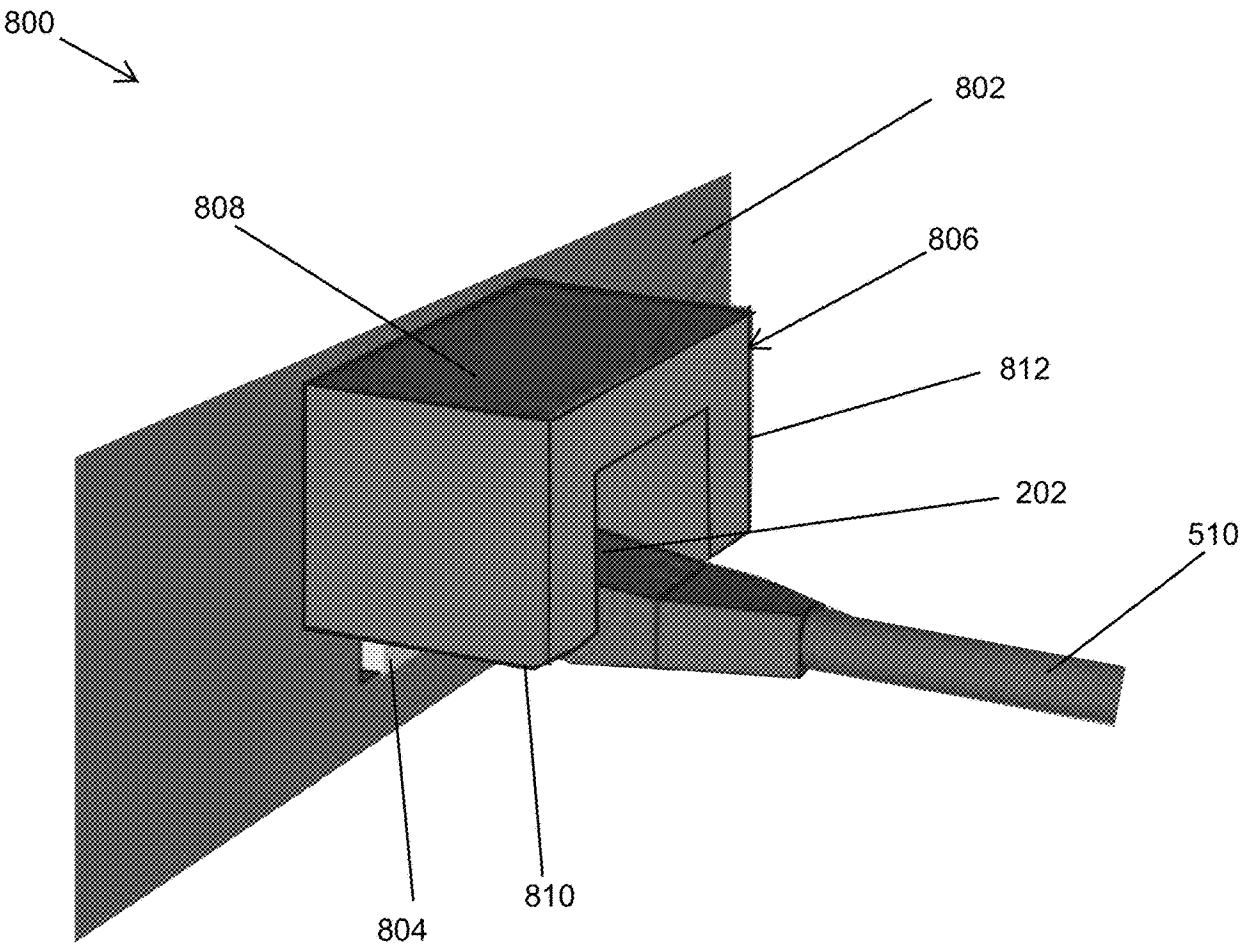
FIG. 8 illustrates a device including an RJ45 socket and a guard switch according to an example embodiment.

FIG. 8 illustrates a device 800 including an RJ45 socket 804 and a guard switch 806 according to an example embodiment. The device 800 may be a lighting fixture, an RJ45 wall socket unit, or another device that may be connected to power source equipment or that may be powered by power source equipment such as the PSE 506 shown in FIG. 5. The RJ45 socket 804 may be a standard RJ45 socket that is positioned through an opening in a wall 802 of the device 800. For example, the RJ45 socket may be an off-the-shelf RJ45 socket that is designed to receive the RJ45 plug 202. The RJ45 plug 202 may terminate the cable 510 that may be a CAT 5e, CAT 6, CAT 8, or another similar cable that can be used to provide power as well as for communications.

As illustrated in FIG. 8, the RJ45 plug 202 is mated with the RJ45 socket 804, and the guard switch 806 is positioned to at least partially cover three sides of the mated RJ45 plug 202 and RJ45 socket 804. In the position of the guard switch 806 shown in FIG. 8, the RJ45 plug 202 and RJ45 socket 804 are electrically connected and the connection of the plug 202 and the socket 804 can be used for communication as well as for power.

In some example embodiments, the guard switch 806 has sidewalls 810, 812, and an upper wall 808 that extends between the sidewalls 810, 812. In FIG. 8, the guard switch 806 is positioned to restrict access to the locking tab of the RJ45 plug 202 and is in a power-on position (i.e., undepressed position). The guard switch 806 is depressible into the device 800 to provide customary access to the locking tab of the RJ45 plug 202. Because the locking tab of the RJ45 plug 202 needs to be pressed to de-mate the RJ45 plug 202 from the RJ45 socket 804, the guard switch 806 is depressed into the device 800 as shown in FIG. 9 to access the locking tab of the RJ45 plug 202.

Figure 9:
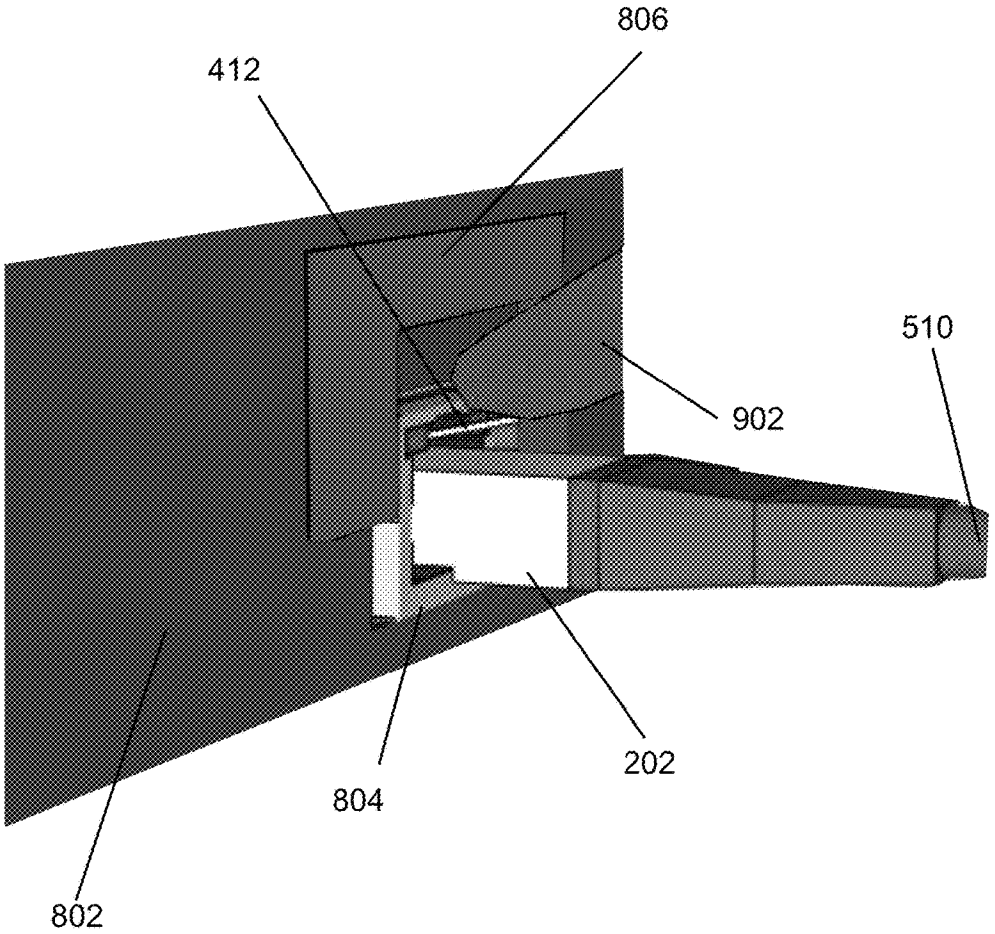
FIG. 9 illustrates the device of FIG. 8 with the guard switch in a power-off position according to an example embodiment.

FIG. 9 illustrates the device 800 of FIG. 8 with the guard switch 806 in a power-off position according to an example embodiment. Referring to FIGS. 8 and 9, when the guard switch 806 is pushed/depressed into the device 800, the locking tab 412 of the RJ45 plug 202 becomes exposed. The RJ45 plug 202 may then be de-mated from the RJ45 socket 804 after pressing on the locking tab 412 to release the RJ45 plug 202 from the RJ45 socket 804. As shown in FIG. 9, the person may press on the locking tab 412 using a finger 902 after the person pushes the guard switch 806 into the device 802.

Pushing/depressing the guard switch 806 to the power-off position shown in FIG. 9 causes power to be disconnected from a load powered through the RJ45 socket 804. In some example embodiments, power may be disconnected after the guard switch 806 has been pushed/depressed from the position shown in FIG. 8 but before the guard switch 806 reaches the position shown in FIG. 9. For example, power may be disconnected after the guard switch 806 has moved a quarter of the distance from the position shown in FIG. 8. Alternatively, the power may be disconnected after the guard switch 806 is depressed a distance that is less or more than a quarter of the distance. For example, the guard switch 806 may need to be in the position shown in FIG. 9 before the power provided via the RJ45 socket 804 is disconnected.

To illustrate, the device 800 may be a lighting fixture that includes light sources (i.e., loads), and power to some or all light sources of the device 800 may be disconnected by pushing/depressing the guard switch 806 to the power-off position before the RJ45 plug 202 is de-mated from the RJ45 socket 804. For example, the switch 806 may turn off power to one or more light sources (e.g., LED light sources) by disconnecting, directly or indirectly, a power path to the one or more light sources through the switch 806, through another component such as a power MOSFET or another component. Considering the device 800 as a RJ45 socket unit that is coupled to power source equipment, such as the PSE 506, the switch 806 may disconnect, directly or indirectly, a power path from the power source equipment to the electrical contacts of the RJ45 socket 804.

By disconnecting electrical power before the RJ45 plug 202 is de-mated from the RJ45 socket 804, electrical arcing between the electrical contacts of the plug 202 and socket 804 can be reduced or eliminated. Further, risk of electrical arcing during the mating of the RJ45 plug 202 with the RJ45 socket 804 can be reduced. For example, the position of the guard switch 806 shown in FIG. 8 indicates to a user a power-on state of the switch 806 indicating that power is not disconnected. Further, the guard switch 806, in the position shown in FIG. 8, restricts access to the RJ45 socket 804, encouraging a user to push/depress the switch 806 to the power-off position of the switch 806 shown in FIG. 9 before plugging the RJ45 plug 202 into the RJ45 socket 804.

Although a particular structure of the guard switch 806 is shown in FIGS. 8 and 9, in some alternative embodiments, the guard switch 806 may have other shapes that restrict access to the locking tab 412 without departing from the scope of this disclosure. For example, in some alternative embodiments, the sidewalls 810, 812 may be omitted; the guard switch 806 may have a curved cross-section; etc. Although the guard switch 806 is shown as a push button switch, in alternative embodiments, the guard switch 806 may be a toggle switch, a slide switch, or another type of switch. The term depress, press or push as used herein may be interpreted to refer to an action (e.g., toggle, slide, etc.) applicable to the particular type of switch. For example, a switch may be toggled or slid to a side so that access to the locking tab 412 is not restricted by the switch while operating the same manner as described with respect to the switch 806.

Figure 10:
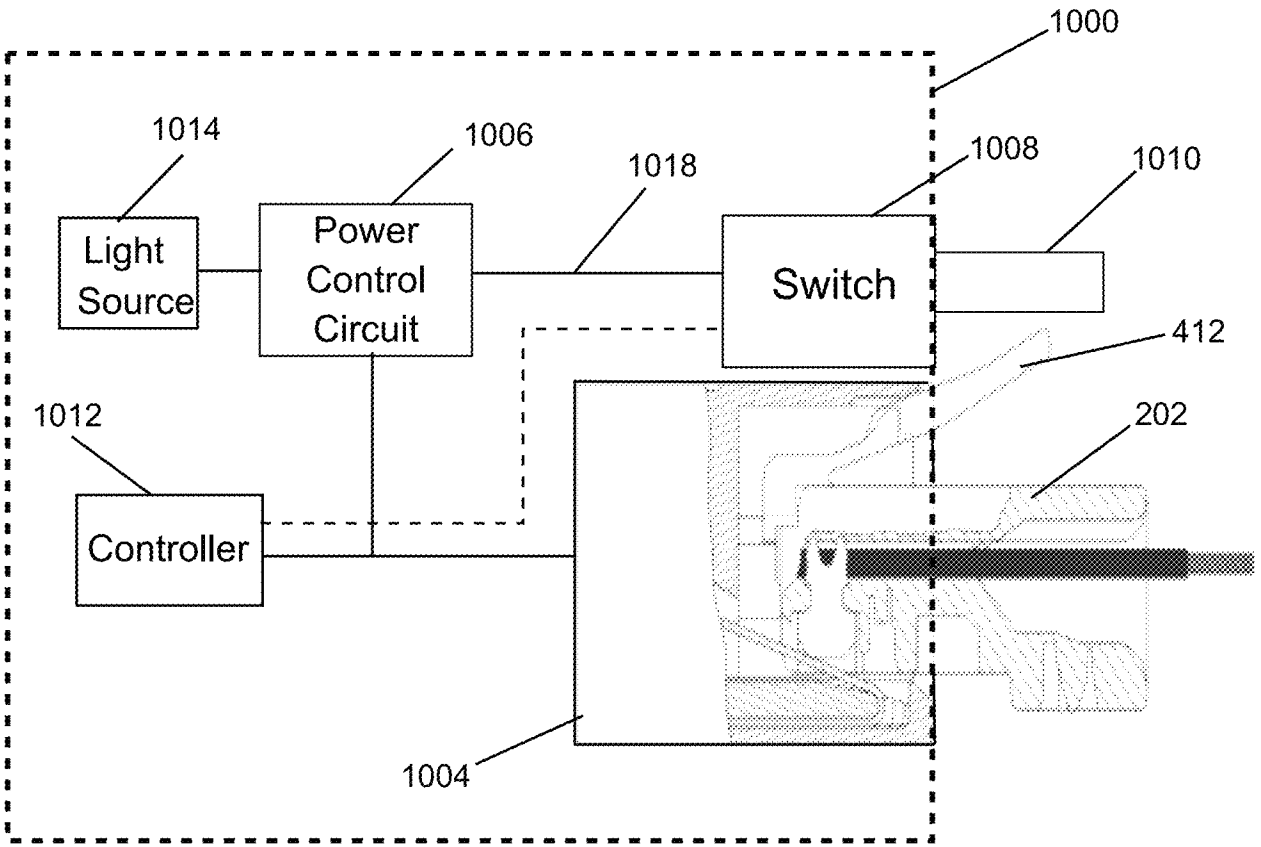
FIGS. 10 and 11 illustrate a load device 1000 including an RJ45 socket 1004 and a guard switch 1008 according to another example embodiment.
Figure 11:
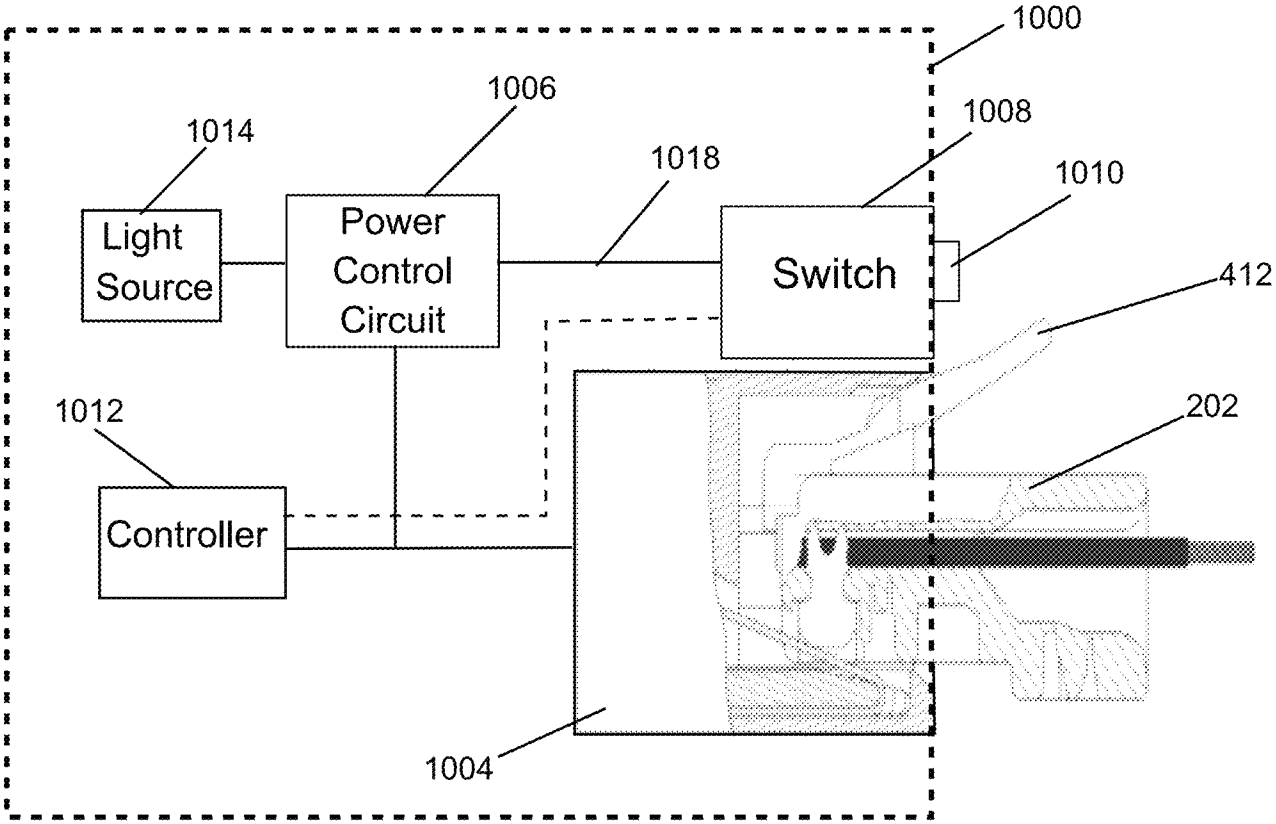

FIGS. 10 and 11 illustrate a load device 1000 including an RJ45 socket 1004 and a guard switch 1008 according to another example embodiment. For example, the load device 1000 may be a light fixture. The load device 1000 includes the RJ45 socket 1004, the guard switch 1008, a power control circuit 1006, and the light source 1014 (e.g., an LED light source). The RJ45 socket 1004 may be a standard RJ45 socket. In FIG. 10, the guard switch 1008 is in a power-on position where power continues to be provided to a light source 1114 of the load device 1000. In FIG. 11, the guard switch 1008 is in a power-off position where power disconnected from the light source 1114. In some example embodiments, the load device 1000 of FIGS. 10 and 11 corresponds to the device 800 of FIGS. 8 and 9.

In some example embodiments, the switch 1008 includes a button 1010 that serves to restrict access to the locking tab 412 of the RJ45 plug 202 when the RJ45 plug 202 mated with the RJ45 socket 1004. To illustrate, the button 1010 is depressible, for example, to the position shown in FIG. 11 to remove the access restriction to the locking tab 412. The button 1010, in the position shown in FIG. 10, can serve to restrict access to the locking tab 412 in a similar manner as described with respect to the switch guard 806 of FIG. 8. After the button 1010 is depressed to the position shown in FIG. 11, the RJ45 plug 202 may be de-mated from the RJ45 socket 1004, after pressing down on the locking tab 412, with reduced or eliminated risk of electrical arcing.

To illustrate, in some example embodiments, the switch 1008 may be electrically coupled to the power control circuit 1006 that provides power to the light source 1014 based on the state of the switch 1008. To illustrate, the power that the power control circuit 1006 provides to the light source 1014 may be received from power source equipment via the RJ45 plug 202 and the RJ45 socket 1004. The power control circuit 1006 may provide the power to the light source 1014 when the switch 1008 is in the power-on position shown in FIG. 10, and the power control circuit 1006 may discontinue the power to the light source 1014 when the switch 1008 is in the power-off position shown in FIG. 11. In some example embodiments, the power control circuit 1006 may include a power MOSFET, a DC-to-DC converter, an AC-to-DC converter, other components including switches, an infrared (IR) receiver to receive infrared signal from the switch 1008, or a combination of two or more of the preceding.

In some example embodiments, the switch 1008 may indicate the position of the switch 1008 (i.e., the position of the button 1010) or control power to the light source 1014 in one of several ways as may be contemplated by those of ordinary skill in the art with the benefit of this disclosure. For example, an electrical signal may be sent to the control circuit 1006 through the switch 1008 via an electrical connection 1018 (e.g., one or more electrical wires), and a voltage level at the connection 1018 may indicate the state of the switch 1008 to the control circuit 1006 or may otherwise be used to control whether power is provided to the light source 1014. To illustrate, the electrical signal may be sent to the switch 1008 by the control circuit 1006, for example, using one of multiple electrical wires of the connection 1018, by a controller 1012, or by another component of the device 1000.

In some alternative embodiments, the switch 1008 may send a signal to indicate the position of the switch 1008 either to the power control circuit 1006 or to the controller 1012. For example, the switch 1008 may send a signal to the controller 1012, and the controller 1012 may send a signal indicating the state of the switch 1008 or otherwise control the power control unit 1006 to turn on and off power to the light source 1014 based on the position of the switch 1008.

By disconnecting electrical power before the RJ45 plug 202 is de-mated from the RJ45 socket 1004, electrical arcing between the electrical contacts of the plug 202 and socket 1004 can be reduced or eliminated. Further, risk of electrical arcing during the mating of the RJ45 plug 202 with the RJ45 socket 1004 can be reduced.

Although particular components and connections are shown in FIGS. 10 and 11, in alternative embodiments, the device 1000 may include different components and connections without departing from the scope of this disclosure. In some alternative embodiments, one or more of the components of the device 1000 may be omitted or integrated into another device without departing from the scope of this disclosure. In some alternative embodiments, the switch 1008 may have a different shape or may be a different type of switch than shown without departing from the scope of this disclosure. Although the switch 1008 is shown as a push button switch, in alternative embodiments, the switch 1008 may be a toggle switch, a slide switch, or another type of switch. Further, the device 1000 may be oriented differently than shown in FIGS. 10 and 11, including the guard switch 1008 being positioned below the RJ45 socket 1004, without departing from the scope of this disclosure.

Figure 12A:
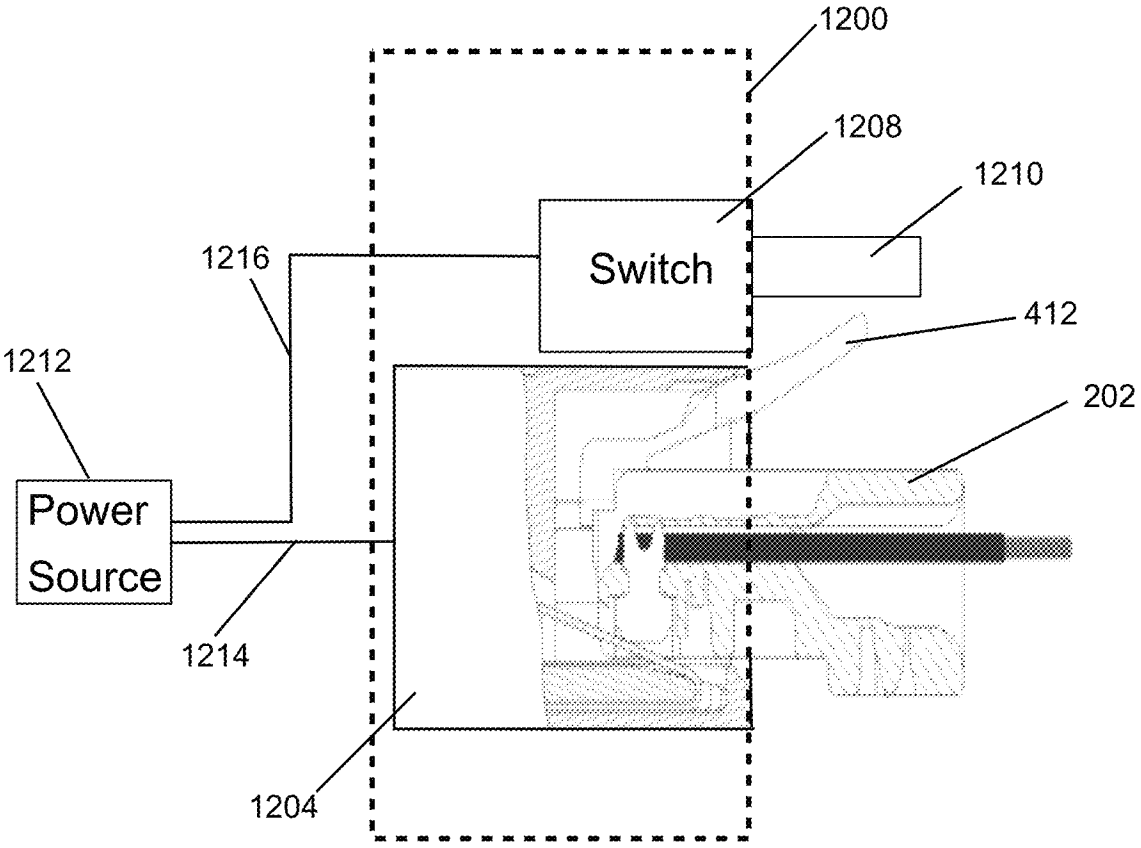
FIGS. 12A and 12B illustrate a device including an RJ45 socket and a guard switch according to another example embodiment.
Figure 12B:
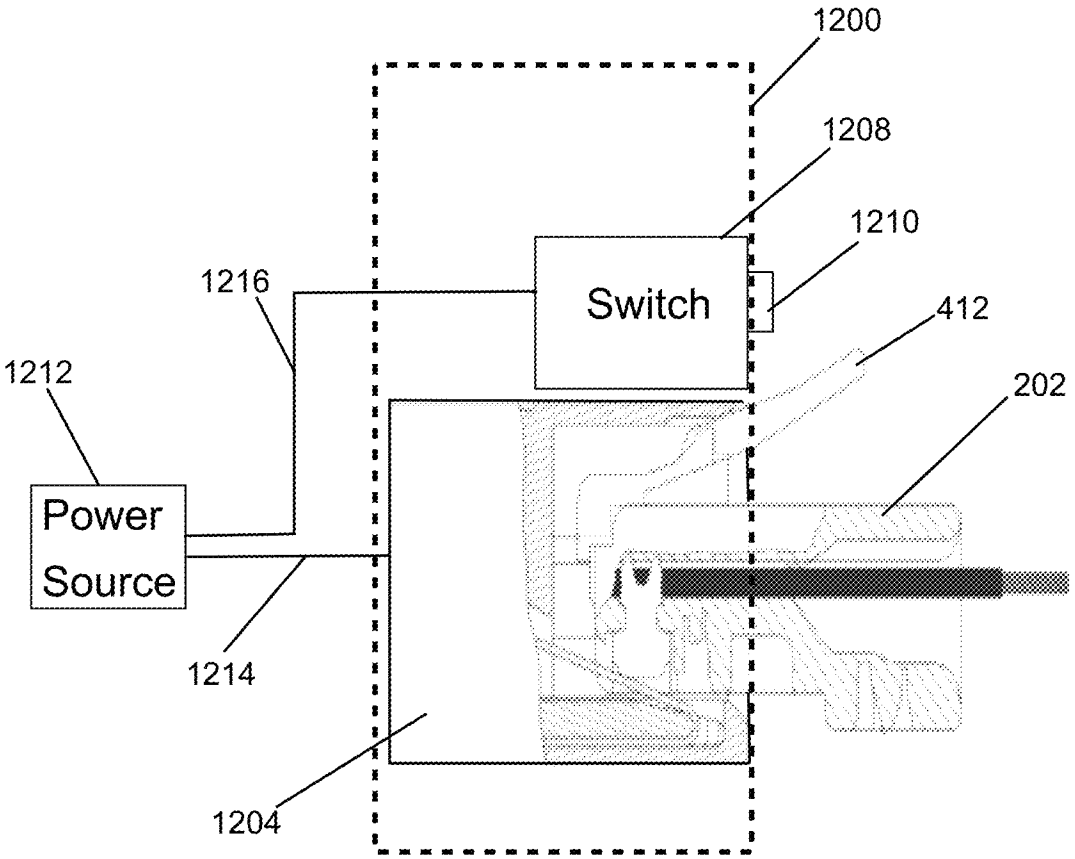

FIGS. 12A and 12B illustrate a device 1200 including an RJ45 socket 1204 and a guard switch 1208 according to another example embodiment. For example, the device 1200 may be a wall RJ45 socket unit that includes the RJ45 socket 1204. The RJ45 socket 1204 may be a standard RJ45 socket. In some example embodiments, the device 1200 of FIGS. 12A and 12B corresponds to the device 800 of FIGS. 8 and 9.

In some example embodiments, the switch 1208 includes a button 1210 that serves to restrict access to the locking tab 412 of the RJ45 plug 202 when the RJ45 plug 202 mated with the RJ45 socket 1204. The button 1210, in the position shown in FIG. 12A, can serve to restrict access to the locking tab 412 in a similar manner as described with respect to the switch guard 806 of FIG. 8 and the switch guard 1008 (including the button 1010) of FIGS. 10 and 11. After the button 1210 is depressed to the position shown in FIG. 12B, the RJ45 plug 202 may be de-mated from the RJ45 socket 1204, after pressing down on the locking tab 412, with reduced or eliminated risk of electrical arcing.

To illustrate, in some example embodiments, the switch 1208 may be electrically coupled to the power source equipment 1212 that provides power to the RJ45 socket 1204 via an electrical connection 1214 based on the state of the switch 1208. For example, the power source equipment 1212 may provide power to a device (e.g., a light fixture) that is connected to the RJ45 socket 1204 by a cable terminated by the RJ45 plug 202.

In some example embodiments, the switch 1208 may indicate the position of the switch 1208 or may otherwise control power to the RJ45 socket 1204 in one of several ways as may be contemplated by those of ordinary skill in the art with the benefit of this disclosure. For example, the power source equipment 1212 may send an electrical signal to itself through the switch 1208 via an electrical connection 1216 (e.g., electrical wires), the power source equipment 1212 may determine the state of the switch 1208 based on, for example, a voltage level of the received signal.

By disconnecting electrical power from the power source equipment 1212 before the RJ45 plug 202 is de-mated from the RJ45 socket 1204, electrical arcing between the electrical contacts of the plug 202 and socket 1204 can be reduced or eliminated. Further, risk of electrical arcing during the mating of the RJ45 plug 202 with the RJ45 socket 1204 can be reduced.

Although particular components and connections are shown in FIGS. 12A and 12B, in alternative embodiments, the device 1200 may include different components and connections without departing from the scope of this disclosure. In some alternative embodiments, the switch 1208 may have a different shape or may be a different type of switch than shown without departing from the scope of this disclosure. Although the switch 1208 is shown as a push button switch, in alternative embodiments, the switch 1208 may be a toggle switch, a slide switch, or another type of switch. Further, the device 1200 may be oriented differently than shown in FIGS. 12A and 12B without departing from the scope of this disclosure.

Although example embodiments have been described, it is to be construed that any features and modifications that are applicable to one embodiment are also applicable to the other embodiments. Furthermore, although the disclosure has been described with reference to specific embodiments, these descriptions are not meant to be construed in a limiting sense. Various modifications of the disclosed embodiments, as well as alternative embodiments of the disclosure will become apparent to persons of ordinary skill in the art upon reference to the description of the example embodiments. It should be appreciated by those of ordinary skill in the art that the conception and the specific embodiments disclosed may be readily utilized as a basis for modifying or designing other structures or methods for carrying out the same purposes of the disclosure. It should also be realized by those of ordinary skill in the art that such equivalent constructions do not depart from the spirit and scope of the disclosure as set forth in the appended claims. It is therefore, contemplated that the claims will cover any such modifications or embodiments that fall within the scope of the disclosure.

What is claimed is:

1. An RJ45 socket having controlled power and comprising:

a housing having a cavity to receive an RJ45 plug;

electrical contacts positioned in the cavity to come in contact with electrical contacts of the RJ45 plug when the RJ45 plug is plugged into the RJ45 socket; and a switch positioned at least partially in the cavity to disconnect power to the electrical contacts of the RJ45 socket based on positions of the RJ45 plug in the cavity, wherein the switch is positioned to disconnect the power to the electrical contacts of the RJ45 socket before the electrical contacts of the RJ45 plug are physically detached from the electrical contacts of the RJ45 socket during a de-mating of the RJ45 plug from the RJ45 socket and wherein the switch is positioned such that the switch is depressed by a locking tab of the RJ45 plug when the RJ45 plug is mated with the RJ45 socket.

2. The RJ45 socket of claim 1, wherein the switch is positioned to connect the power to the electrical contacts of the RJ45 socket based on positions of the RJ45 plug in the cavity and wherein the switch connects power to the electrical contacts of the RJ45 socket after the electrical contacts of the RJ45 socket are in physical contact with the electrical contacts of the RJ45 plug during a mating of the RJ45 plug with the RJ45 socket.

3. The RJ45 socket of claim 2, wherein a power source provides the power to the electrical contacts of the RJ45 socket through the switch, wherein the switch is closed when depressed by the RJ45 plug, and wherein the switch is depressed by the RJ45 plug when the RJ45 plug is fully mated with the RJ45 socket.

4. The RJ45 socket of claim 1, wherein the electrical contacts of the RJ45 socket are coupled to the switch, wherein the switch disconnects the power to the electrical contacts of the RJ45 socket when the switch is undepressed, and wherein the switch is undepressed before the electrical contacts of the RJ45 plug are physically detached from the electrical contacts of the RJ45 socket during the de-mating of the RJ45 plug from the RJ45 socket.

5. The RJ45 socket of claim 4, wherein a power source provides the power to the electrical contacts of the RJ45 socket through the switch and wherein the switch is open when the switch is undepressed.

6. The RJ45 socket of claim 1, wherein a power source provides the power to the electrical contacts of the RJ45 socket using an electrical cable that is coupled to the power source and to the electrical contacts of the RJ45 socket and wherein the switch disconnects the power to the electrical contacts of the RJ45 socket by indicating, using an electrical signal, to the power source to disconnect the power.

7. The RJ45 socket of claim 1, wherein the switch is positioned at a back wall of the housing.

8. The RJ45 socket of claim 1, wherein the switch is positioned at a side wall of the housing.

9. The RJ45 socket of claim 1, wherein the switch is a momentary switch.

10. An RJ45 socket having controlled power and comprising:

a housing having a cavity to receive an RJ45 plug;

electrical contacts positioned in the cavity to come in contact with electrical contacts of the RJ45 plug when the RJ45 plug is plugged into the RJ45 socket; and a switch positioned at least partially in the cavity and configured to send an electrical signal to a controller that is external to the housing, the electrical signal indicating whether the switch is depressed or undepressed, wherein the switch is depressed by the RJ45 plug when the RJ45 plug is mated with the RJ45 socket, wherein the controller controls whether power is provided to the electrical contacts of the RJ45 socket based on whether the electrical signal indicates that the switch is depressed or undepressed, wherein the controller disconnects the power before the electrical contacts of the RJ45 plug are physically detached from the electrical contacts of the RJ45 socket during de-mating of the RJ45 plug from the RJ45 socket.

11. The RJ45 socket of claim 10, wherein the switch is positioned to indicate to the controller that the switch is depressed after the electrical contacts of the RJ45 socket are in physical contact with the electrical contacts of the RJ45 plug during a mating of the RJ45 plug with the RJ45 socket.

12. The RJ45 socket of claim 10, wherein the controller disconnects the power to the electrical contacts of the RJ45 socket when the switch is undepressed and wherein the switch is undepressed before the electrical contacts of the RJ45 plug are physically detached from the electrical contacts of the RJ45 socket during the de-mating of the RJ45 plug from the RJ45 socket.

13. The RJ45 socket of claim 10, wherein the switch is positioned at a back wall of the housing.

14. The RJ45 socket of claim 10, wherein the switch is positioned at a side wall of the housing to be depressed by a locking tab of the RJ45 plug when the RJ45 plug is mated with the RJ45 socket.

15. The RJ45 socket of claim 10, wherein the switch is a momentary switch.

* * * * *